US005236187A

United States Patent [19]

Mizutani

[11] Patent Number: 5,236,187

[45] Date of Patent: Aug. 17, 1993

[54] SHEET-FEEDING CASSETTE APPARATUS

[75] Inventor: Naoki Mizutani, Takarazuka, Japan

[73] Assignee: Mita Industrial Co., Ltd., Japan

[21] Appl. No.: 848,282

[22] Filed: Mar. 9, 1992

[30] Foreign Application Priority Data

| | | | |
|---|---|---|---|
| Mar. 12, 1991 | [JP] | Japan | 3-073886 |
| Mar. 12, 1991 | [JP] | Japan | 3-073887 |
| Mar. 12, 1991 | [JP] | Japan | 3-073888 |
| Nov. 20, 1991 | [JP] | Japan | 3-29611 |

[51] Int. Cl.[5] ..... B65H 3/06

[52] U.S. Cl. ..... 271/117; 271/127; 271/164

[58] Field of Search ..... 271/162, 164, 117, 127

[56] References Cited

U.S. PATENT DOCUMENTS 4,402,498 9/1983 Suzuki ..... 271/164
5,139,252 8/1992 Morita ..... 271/164 X

FOREIGN PATENT DOCUMENTS 121908 10/1984 European Pat. Off. .

OTHER PUBLICATIONS

Patent Abstracts of Japan, vol. 9, No. 226 (M-412) [1949], Sep. 12, 1985; & JP-A-60 082 538 (Fuji Xerox).
Europen Search Report and Annex.

*Primary Examiner*—Richard A. Schacher
*Attorney, Agent, or Firm*—Beveridge, DeGrandi, Weilacher and Young

[57] ABSTRACT

A feed cassette apparatus for retaining a loaded feed cassette in a cassette housing space containing a feed roller, wherein the feed cassette is loaded or unloaded in the direction parallel to the axis of the feed roller. The apparatus includes a cassette case and a plurality of positioning devices. The cassette case is movable in the feed-cassette loading direction and is capable of housing feed cassettes of different sizes. The positioning devices are disposed at different positions in the cassette case to suit the different-sized feed cassettes, and position the end of a stack of sheets in a given feed cassette under the feed roller. A feed cassette to be housed in the cassette case is positioned by the positioning device corresponding to the feed cassette size. As a result, when the cassette case is moved in the loading direction in order to load the feed cassette into the cassette housing space, the end of the stack of sheets in the feed cassette is brought precisely into position under the feed roller.

22 Claims, 11 Drawing Sheets

SHEET-FEEDING CASSETTE APPARATUS

BACKGROUND OF THE INVENTION

The present invention relates to sheet-feeding cassettes and sheet-feeding rollers, and more particularly, to a sheet-feeding cassette apparatus and an associated feed roller apparatus which are removably housed in an image forming apparatus.

Japanese Utility Model Laying-Open No. 23130/1991 discloses a copying machine in which paper-feed cassettes are front-loaded into the apparatus body. The copying machine body incorporates a plurality of cassette housing spaces which open onto the front of the machine. A paper feed cassette is installed into a cassette case (outer case), which then is detachably loaded into one of the cassette housing spaces.

Since each cassette case can house only a given-size feed cassette, cases corresponding to each desired feed cassette size must be provided. However, the number of cases the copying machine can contain at one time is necessarily limited, which becomes inconvenient wherein several sheet sizes are employed. Moreover, a feed cassette when loaded is moved in the horizontal direction, and a feed roller in the machine tends to catch on the uppermost sheet in the feed cassette, causing the sheet to shift horizontally.

Japanese Utility Model Laying-Open No. 21630/1988 discloses an apparatus to prevent horizontal shifting of sheets when a feed cassette is loaded into a copying machine. A feed cassette of the apparatus is slid into the machine body horizontally beneath a feed roller, during which movement the cassette does not contact the roller. Then, after the horizontal loading is completed, the stack of sheets in the feed cassette is raised by a spring member so as to come into contact with the feed roller.

However, the spring members together being of uniform spring constant cannot as such compensate the variety of sheet stack weights which arise according to the size of sheet used. Consequently, the force elevating the sheet stack toward the feed roller may be inappropriate for the stack weight and may degrade the sheet-feeding performance.

Japanese Utility Model Laying-Open No. 23130/1991 discloses a copying machine which comprises a feed roller apparatus for feeding sheets loaded in a feed cassette to a sheet transport path. The feed roller apparatus comprises an axle, and a feed roller, mounted along the middle of the axle, which rides on the uppermost sheet in the feed cassette. When the feed roller is rotated by the axle, the uppermost sheet is supplied to the transport path. The surface layer of the feed roller is formed of a high-friction material such as synthetic rubber. However, after repeated use, the feed roller is subject to wear and must be replaced.

However, the various associated elements disposed in the proximity of the feed roller as mounted mid-axle interfere with the roller, encumbering the replacement operation.

SUMMARY OF THE INVENTION

It is an object of the present invention to improve the reliability of a sheet-feeding arrangement in an image-forming apparatus.

It is another object that the sheet housing means of an image forming apparatus be suitable for several sheet sizes.

It is yet another object of the present invention to enable the replacement of a feed roller of a sheet-feeding mechanism in an image-forming apparatus to be smooth and unencumbered.

(1) A feed cassette apparatus of an image-forming apparatus according to an aspect of the present invention is loaded into a cassette housing space containing a feed roller. The feed cassette apparatus is loaded and unloaded in the direction parallel to the feed roller axis. The apparatus includes a cassette case and a plurality of positioning means. The cassette case is movable in the cassette loading direction and houses one from among several sizes of feed cassettes. The positioning means are located at different positions in the cassette case to correspond to the different sizes of feed cassettes.

Thus a feed cassette of a particular size is positioned in the cassette case by the corresponding positioning means, making the feed cassette apparatus suitable for several sheet sizes.

(2) A feed cassette apparatus according to another aspect of the present invention incorporates feed cassettes having means for applying pressure against loaded sheets wherein the pressure is relative to a given size of sheet. The apparatus includes a cassette case, supporting means and raising means. The cassette case in which one of the feed cassettes is detachably housed is movable in the axial direction of the feed roller. The supporting means is pivotal and supports the cassette case on the side furthest from the feed roller. The raising means raises the cassette case along the side closest to the feed roller, whereby a sheet in the feed cassette is brought into contact with the feed roller. Accordingly, feeding pressure suitable for the sheet size is provided and consequently feeding performance is improved. In addition, since the cassette case is pivoted about the side away from the feed roller, and the top sheet in the feed cassette is abutted on the feed roller by appropriate raising means, proper contact of the sheet with the feed roller is ensured, further improving sheet-feeding performance.

(3) A feed roller apparatus according to still another aspect of the present invention includes: a rotation axle having a support shaft and an input shaft and which is movable in the axial direction; connecting means for detachably connecting the support shaft to the input shaft; a feed roller for sheet feeding which is detachably mounted onto the support portion; and driving means connected to the input shaft of the rotation axle, for driving the rotation axle.

When the feed roller is to be replaced, first the support shaft is disconnected from the input shaft. The feed roller is then detached from the support shaft by drawing out the support shaft in the axial direction. Then, a new feed roller is mounted on the support shaft and the support shaft is reconnected to the input shaft. Accordingly, since the support shaft is disconnected from the input shaft having the driving means when the feed roller is replaced, feed roller replacement is greatly facilitated.

The foregoing and other objects and advantages of the present invention will be more fully apparent from the following detailed description.

DETAILED DESCRIPTION OF PREFERRED EMBODIMENTS

Figure 1:
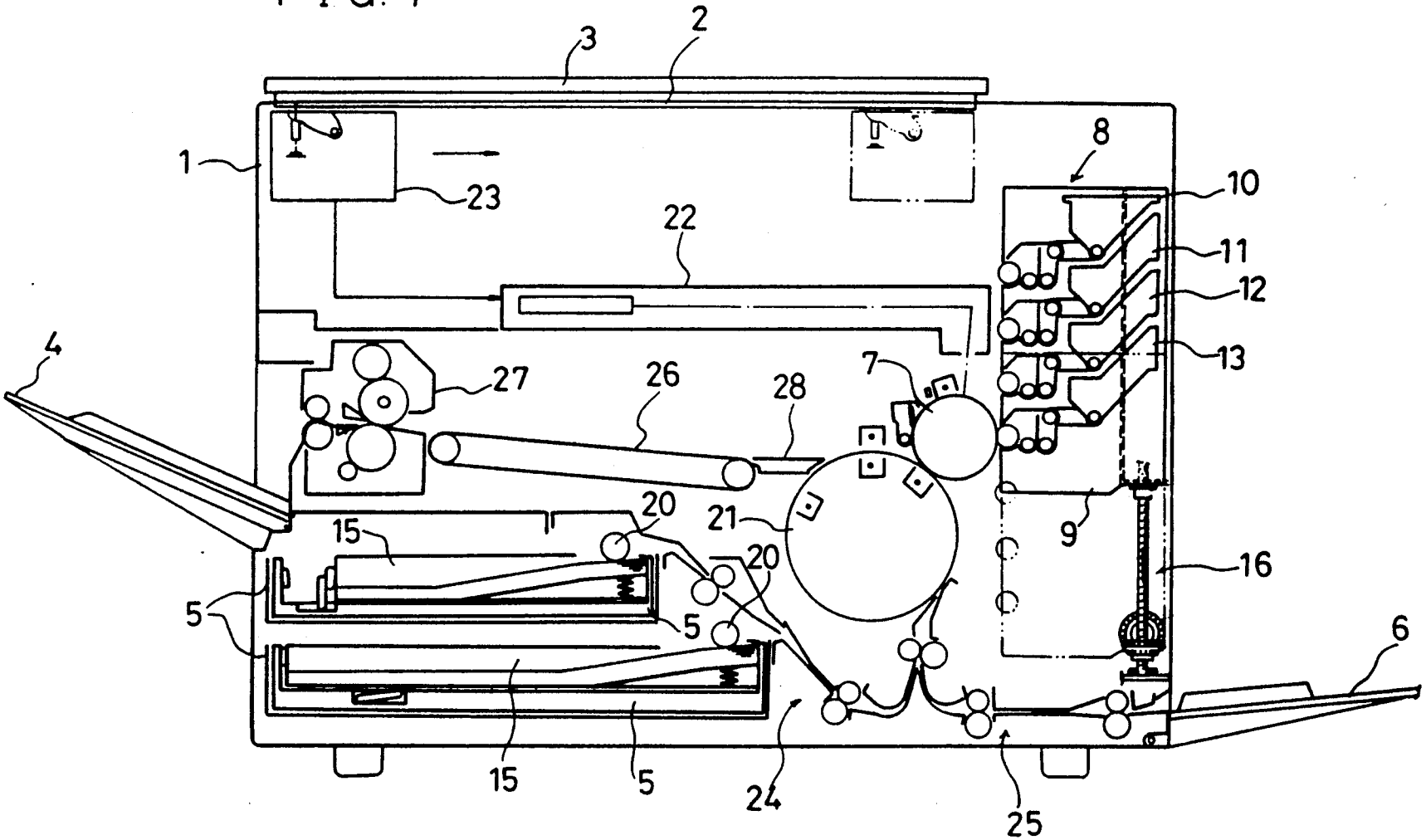
FIG. 1 is a schematic elevational view showing a copying machine according to an embodiment of the present invention.

Referring to FIG. 1, a copying machine is shown to have an original retainer 2 disposed in the upper portion of the machine body 1, and an original cover 3 hinge-mounted on top of the original retainer 2. A copy tray 4, and cassette cases 5, in which feed cassettes 15 are housed and which are supported by support mechanism 14, are provided in the left portion of the machine body 1 in the figure; and a bypass feed tray 6 is provided in the right portion thereof.

A photoconductor drum 7 is disposed within the copying machine body 1. Surrounding the photoconductor drum 7, there are a charger, a transfer unit, a detach unit and a cleaning unit, as well as a developing section 8 which includes vertically arranged developing units 10, 11, 12 and 13 for developing images in magenta, cyan, yellow and black, respectively. These developing units 10 to 13 are supported by a movable frame 9, which is vertically conveyed by means of a conveyance mechanism 16.

Disposed over the photoconductor drum 7 is a laser unit 22 which emits a laser beam onto the upper surface of the photoconductor drum 7. Between the laser unit 22 and the original retainer 2, an image reader 23 comprising charge-coupling devices (CCDs) is disposed. The image reader 23 is driven to reciprocate horizontally in the figure, so as to scan an original placed on the original retainer 2. The image information thus obtained by the image reader 23 is supplied in the form of electrical signals to the laser unit 22.

A transfer drum 21 is disposed adjacent to the photoconductor drum 7. Under the transfer drum 21 and between the feed cassettes 15 and the bypass feed tray 6 are sheet transport mechanisms 24 and 25 consisting of guide plates and transport rollers. Disposed between the transfer drum 21 and the copy tray 4 is a sheet transport mechanism 26 and an image fixing unit 27 in that order from the transfer drum 21. Separation claws 28 for separating a printing sheet from the transfer drum 21 are provided between the transfer drum 21 and the sheet transport mechanism 26.

Figure 2:
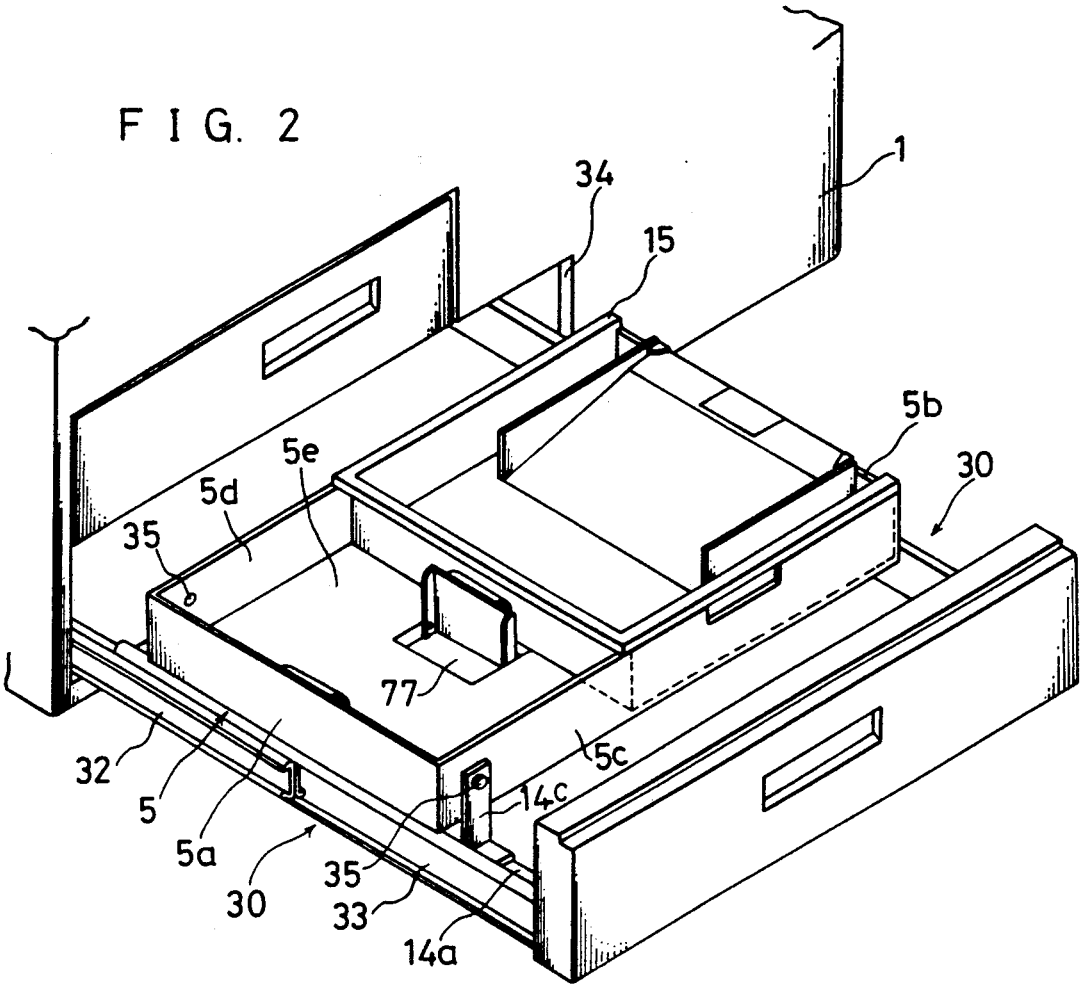
FIG. 2 is a perspective view showing a cassette case in a drawn position from the copying machine.
Figure 3:
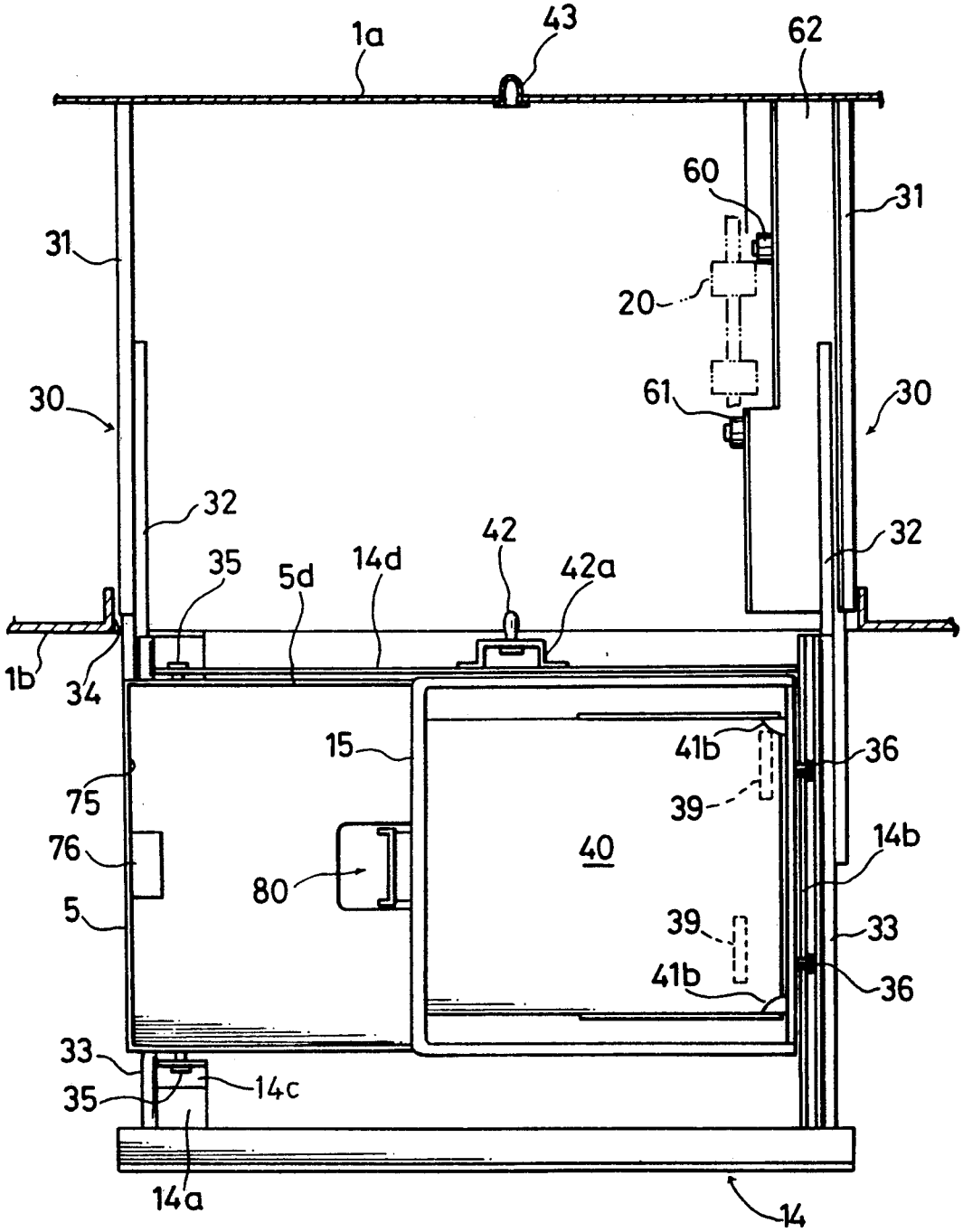
FIG. 3 is a sectional plan view of the condition the same as shown in FIG. 2.
Figure 4:
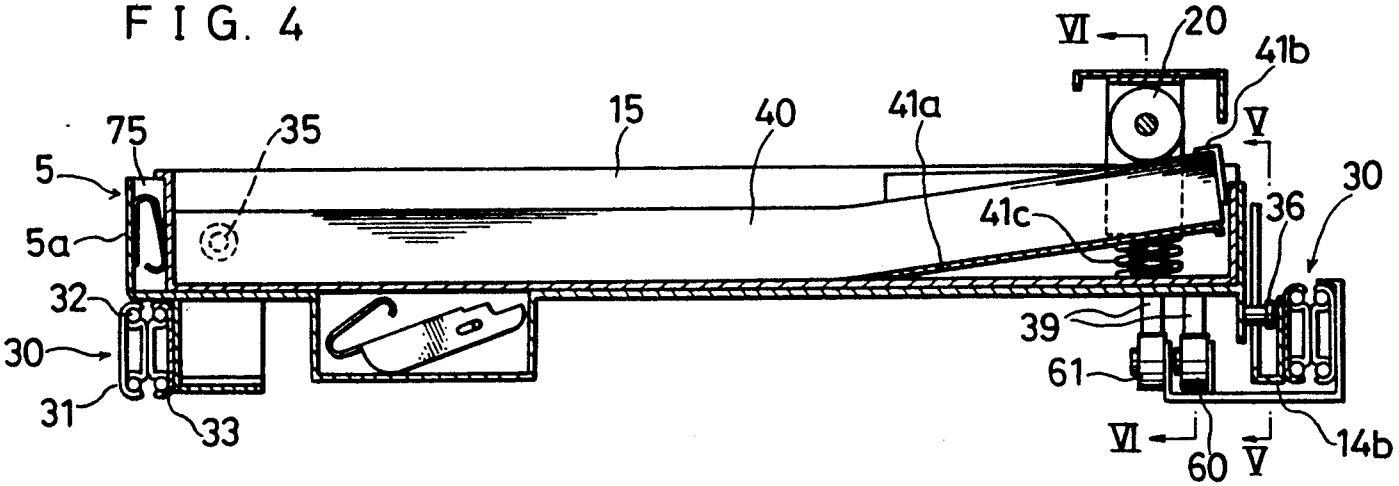
FIG. 4 is a cross-sectional side view of the cassette case in a housed position in the copying machine.

As shown in FIGS. 2 to 4, a pair of slide mechanisms 30, such as those sold under the Japanese trademark "Accuride", is disposed in the front-to-rear direction (vertical direction in FIG. 3). Each slide mechanism 30 consists of a fixed channel 31 C-shaped in cross section, one end of which is fixed to the copying machine body 1, an intermediate sliding bracket 32 slidable along the fixed member 31, and a sliding channel 33 C-shaped in cross section and supported by the sliding bracket 32. The sliding bracket 32 and the sliding channel 33 can be drawn out of the copying machine body 1 through an opening 34 formed in a front panel 1*b* of the machine body 1.

Figure 5:
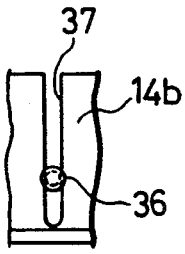
FIG. 5 is a partly in sectional view taken along the line V—V of FIG. 4.
Figure 6:
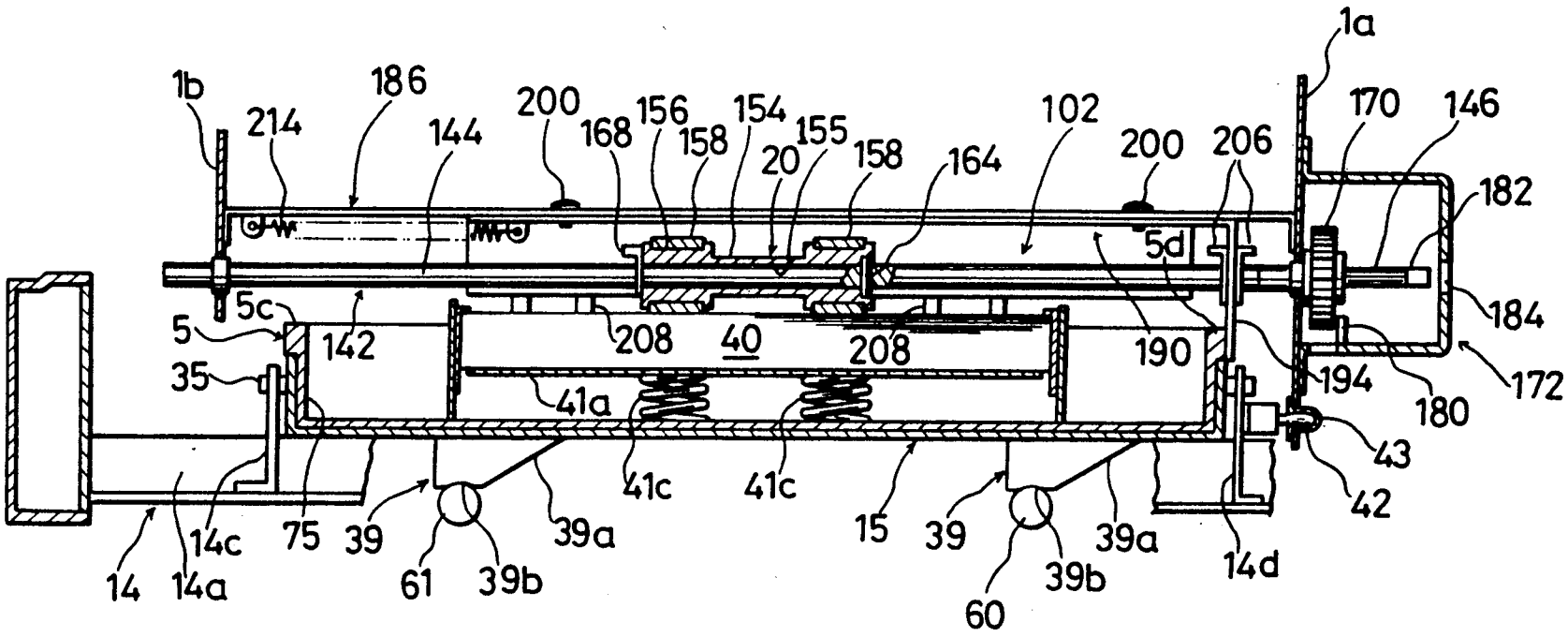
FIG. 6 is a partly in sectional view taken along the line VI—VI of FIG. 4.

Each cassette case 5 supported by the support mechanism 14 is disposed between a pair of the slide mechanisms 30. The cassette case 5 is rectangular and comprises side plates 5*a*, 5*b*, 5*c* and 5*d*, and a bottom plate 5*e*. The support mechanism 14 includes a case supporting member 14*a* and a case guide member 14*b*, which are fixed to the sliding channels 33. Standing on the case supporting member 14*a* is a support tab 14*c*. A supporting plate 14*d* is disposed between the members 14*a* and 14*b*. One end of the cassette case 5 is pivotably connected to the tab 14*c* and the supporting plate 14*d* by means of a pair of pins 35 the axes of which lie in the machine front-to-rear direction. As shown in FIGS. 3 and 4, pins 36 are provided on the cassette case 5, where they project into vertically extending guide slots 37, formed in the side plate 14*b* to guide the pins 36, as shown in FIG. 5. The pins 36 being vertically movable along the guide slot 37 permits the cassette case 5 to pivot about the pins 35. A pair of rails 39 is fixed to the bottom plate 5*e* of the cassette case 5, extending in the front-to-rear direction. Each rail 39 has an oblique surface 39*a* dropping from the machine-rearward end, and a recess 39*b* formed along its bottom end, as shown in FIG. 6.

A pair of rollers 60 and 61 are disposed at positions in the copying machine body 1 corresponding to the rails 39. The rollers 60 and 61 are rotatable about horizontal axes, and are supported by a bridge 62 provided between the front panel 1*b* and a rear panel 1*a*, as shown in FIG. 3.

Figure 7:
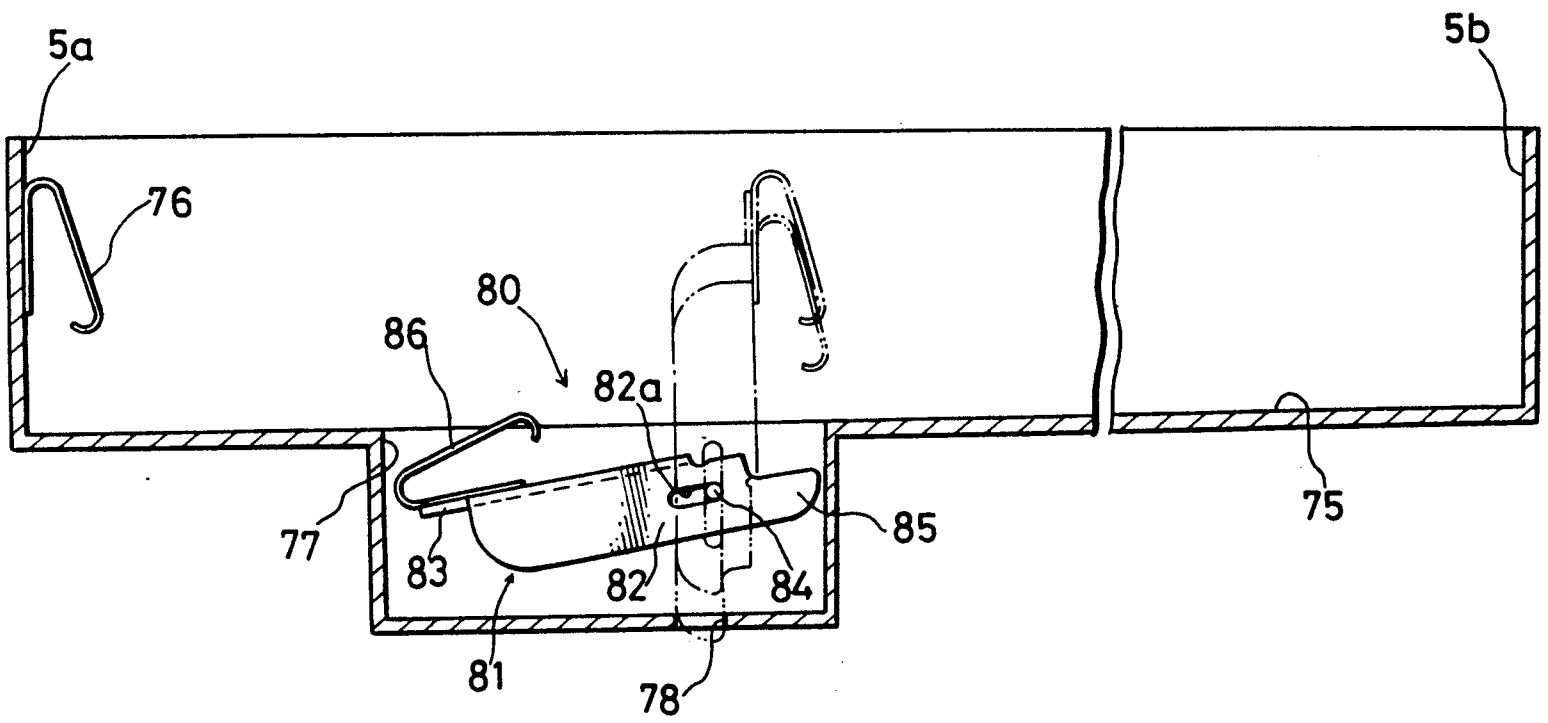
FIG. 7 is an elevational view of the cassette case.

The side plates 5*a* to 5*d* and the bottom plate 5*e* of the cassette case 5 define a housing space 75 for housing a feed cassette 15. Attached to side plate 5*a* of the housing space 75 is a flat spring 76, illustrative of the positioning means, as shown in FIG. 7. The feed cassettes 15 for housing in the cassette case 5 come in several sizes to suit corresponding sheet sizes, as shown in FIG. 1. The feed cassette 15 of FIG. 4 is held in retention within the housing space 75 by the flat spring 76. A recess 77 is formed in the bottom plate 5*e* of the housing space 75. The recess 77 is located to correspond to one side of a small-size feed cassette 15. An additional positioning means 80 is provided within the recess 77.

The positioning means 80 comprises a pressing means 81 and an attached flat spring 86. The pressing means 81 consists of a pair of side plates 82 and an integral connecting plate 83 formed between the side plates 82. The flat spring 86 is fixed along a margin of the connecting plate 83. A slot 82*a* is formed in each side plate 82, inserted into each slot 82*a* is a pin 84 fixed to the cassette case 5. The pressing means 81 includes projections 85 from the ends near the pins 84, is capable thereby of vertical insertion into a hole 78 formed in the bottom of the recess 77.

The positioning means 80 can be pivoted between a retracted position (indicated by solid lines in FIG. 7), wherein it is housed within the recess 77, and an upright position (indicated by single-dotted broken lines), and further can be slid down from the upright position into a locked position (indicated by double-dotted broken lines), wherein the projection 85 has been fitted into the hole 78. In the locked position, the flat spring 86 serves to abut on one side of the small-size feed cassette 15, whereby the feed cassette 15 is held in retention within the housing space 75.

As shown in FIGS. 3 and 6, a knob 42 made of, for example, a resin protrudes rearward from the middle of the supporting plate 14*d*. The knob 42 is fixed to a base 42*a* on the supporting plate 14*d*. Likewise, a clasper 43 which may also be made of a resin is provided in the rear panel 1*a* at a position corresponding to the knob 42 for detachable engagement therewith. The knob 42 and the clasper 43 thus constitute a catching mechanism.

As shown in FIG. 4, the feed cassette 5 includes a lifting member 41*a* elevating one end of a stack of sheets 40, clasps 41*b* for retaining the upper corners of the end of the stack of sheets 40, and coil springs 41*c* which elastically sustain the lifting member 41*a*. The elastic force of the coil springs 41*c* is set so that the coil springs 41*c* provide appropriate feed pressure in accordance with the size (or, more precisely, weight) of the sheets 40 housed in the feed cassette 15.

A feed roller 20 disposed above the lifting member 41*a* of the feed cassette 15 is mounted within the copying machine body 1.

Figure 8:
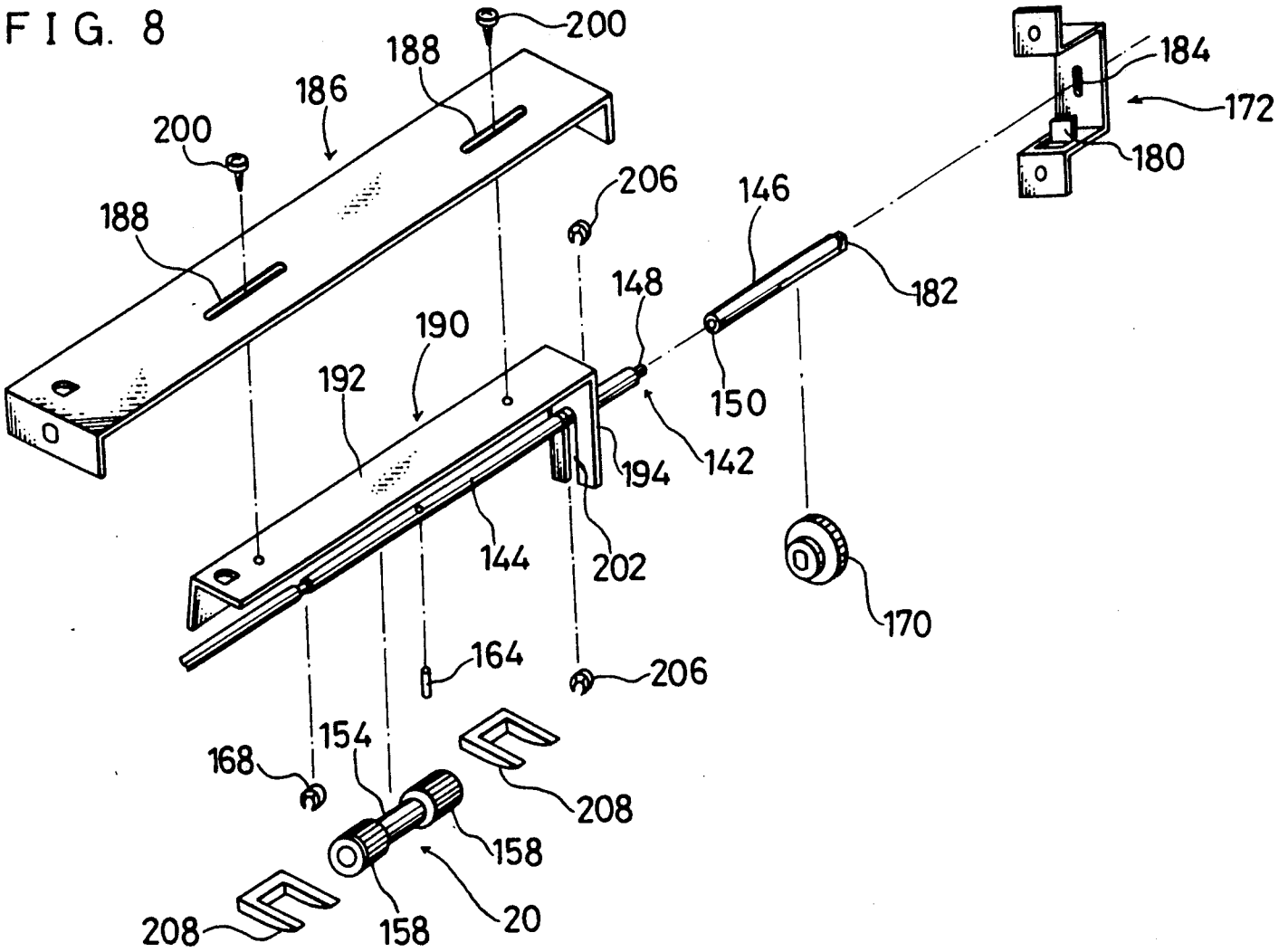
FIG. 8 is an exploded perspective view of a feed roller mechanism.

As shown in FIG. 6, a feed roller mechanism 102 comprising the feed roller 20 has an axle 142 which is rotatably supported by bearings and movable in the front-to-rear direction (horizontal direction in FIG. 6). The axle 142 consists of a support shaft 144 and an input shaft 146. As shown in FIG. 8, threaded collar 148 is formed on the rear end of the support shaft 144. A threaded socket 150 is formed on the forward end of the input portion 146. By screwing the collar 148 into the socket 150, the support shaft 144 is concentrically connected to the input shaft 146. The threads of the collar 148 and the socket 150 are tapped in the direction such that they will not loosen when rotating force is applied, as described later.

The feed roller 20 is mounted along the middle of the support shaft 144. The feed roller 20 comprises a roller base 154 formed of, for example, a synthetic resin, is substantially cylindrical in shape and fits over the support shaft 144. Both side ends of the roller base 154 are greater in diameter than the midsection, and formed in each is a circumferential channel 156. A friction ring 158, which may be formed of a synthetic rubber having a high coefficient of friction, is fitted into each channel 156. The friction rings 158 abut on the upper surface of the sheet stack 40.

As shown in FIG. 6, the rear end of the roller base 154 is connected to the support shaft by means of a pin 164. A stop ring 168 fitted onto the support shaft 144 abuts against the front end of the roller base 154, thereby retaining the feed roller 20 on the support shaft 144.

Mounted on a portion of the input shaft 146 of the axle 142 projecting beyond the rear panel 1*a* is an input gear 170. The input gear 170 is slidable but non-rotatable with respect to the input shaft 146, and is coupled to a driving source (not shown) which includes an electric motor.

A cover 172 is mounted on the rear panel 1*a* over the input shaft 146, and extending in its middle portion is a vertical slot 184. The slot 184 is formed to mate with a projection 182 protruding from the rear end of the input shaft 146. By means of fitting the projection 182 into the slot 184 (FIG. 9) the input shaft 146 is captured against rotation. Needless to say, since the input shaft 146 ordinarily separated from the slot 184, the rotation of the input shaft 146 is in no way obstructed. A stop 180 is provided in the cover 172 adjacent to the gear 170 in order to limit its backward movement.

A mounting bracket 186 is positioned over the feed roller 20 and extends between the front and rear panels 1*b* and 1*a*. A linking bracket 190 is supported by the mounting bracket 186. As shown in FIG. 8, a pair of pins 200 fixed to the linking bracket 190 are inserted into longitudinal slits 188 formed in the mounting member 186, whereby the link 190 is movable in the lengthwise direction of the mounting bracket 186, or in the front-to-rear direction.

The linking bracket 190 has a connecting arm 194 extending downward from its rear end, and is forked by a vertical notch 202. The support shaft 144 is rotatably retained in the notch 202 of the connecting arm 194, by stops 206, which prevents the support shaft 144 from sliding in the axial direction.

A pair of guide members 208 are fixed to the linking bracket 190. The guide members 208 restrict a sheet from the stack 40 against upward displacement when it is transported out from the feed cassette 15 by the feed roller 20, as will be described later.

As shown in FIG. 6, an extension spring 214 is provided between the end of the mounting bracket 186 near the front panel 1*b* and the front end of the linking bracket 190. The extension spring 214 thus tensions the linking bracket 190 forward.

A discussion of the functioning of the embodiment of the present invention as described above follows.

Figure 10:
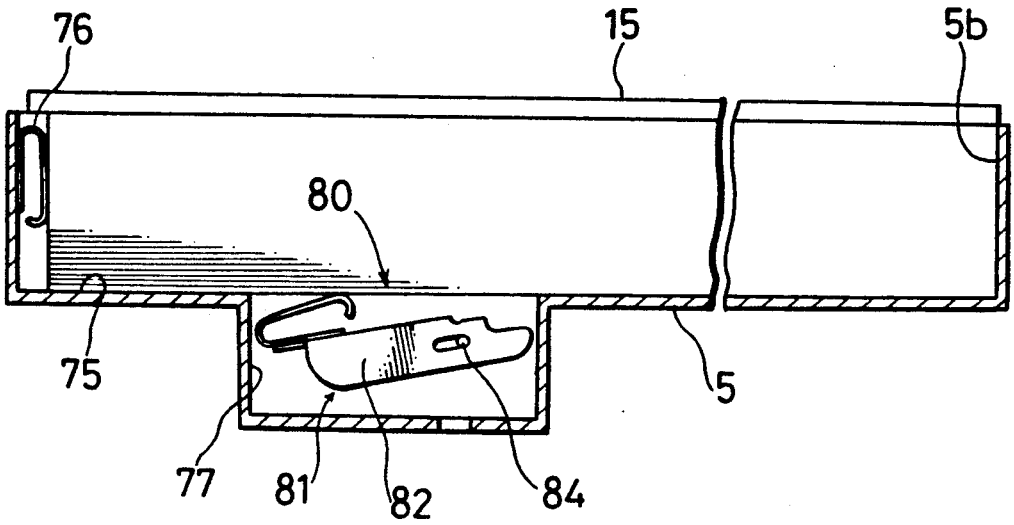
FIG. 10 is an elevational view showing a feed cassette in one operational state.

In order to install a feed cassette 15 in the cassette case 5, the support mechanism 14 and the cassette case 5 are first drawn out of the copying machine body 1 (FIGS. 2 and 3). Then, the feed cassette 15 is loaded into the cassette case 5. If the feed cassette 15 is of large size, the positioning means 80 is set into the retracted position as shown in FIG. 10. When the feed cassette 15 is thus housed in the housing space 75 of the cassette case 5, the right end of the feed cassette 15 abuts on the side wall 5*b* of the cassette case 5 and the opposite end is pressed by the force of the flat spring 76. Thus, the feed cassette 15 is located into the proper position within the housing space 75.

Figure 11:
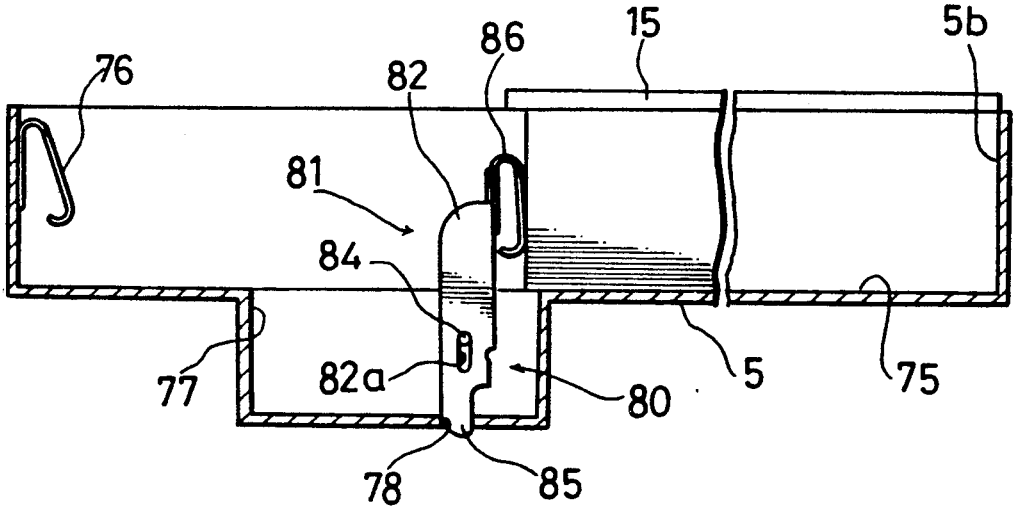
FIG. 11 is a view corresponding to FIG. 10, showing the feed cassette in another operational state.

If the feed cassette 15 is of small size, it is installed into the housing space 75 such that the right end of the feed cassette 15 contacts the side wall 5*b* as shown in FIG. 11. Then, the positioning means 80 is pivoted about the pins 84 to assume the upright position, the pressing means 81 being slid downward so that the projections 85 insert into the hole 78. Thus, the positioning means 80 assumes the locked position within the recess 77, while the flat spring 86 makes compressive contact with the facing end of the feed cassette 15. As a result, the feed cassette 15 is located into the proper position within the housing space 75 of the cassette case 5.

It is clear from the foregoing description that the invention thus embodied enables feed cassettes 15 of several different sizes to be properly positioned within the cassette cases 5.

The cassette case 5 having the feed cassette 15 installed is then inserted into the copying machine body 1. The cassette case 5 slides into its cassette housing space by means of the slide mechanism 30.

Figure 12:
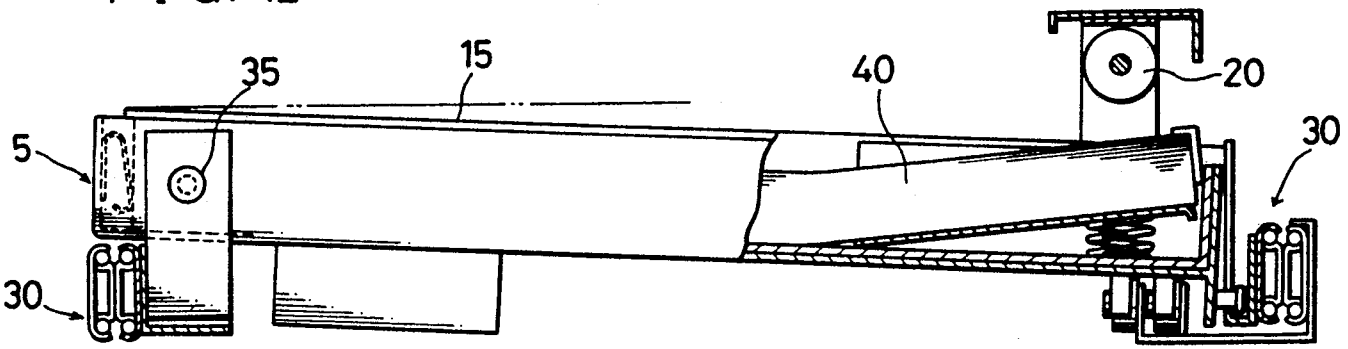
FIG. 12 is a view corresponding to FIG. 4, showing the cassette case in one operational state.
Figure 13:
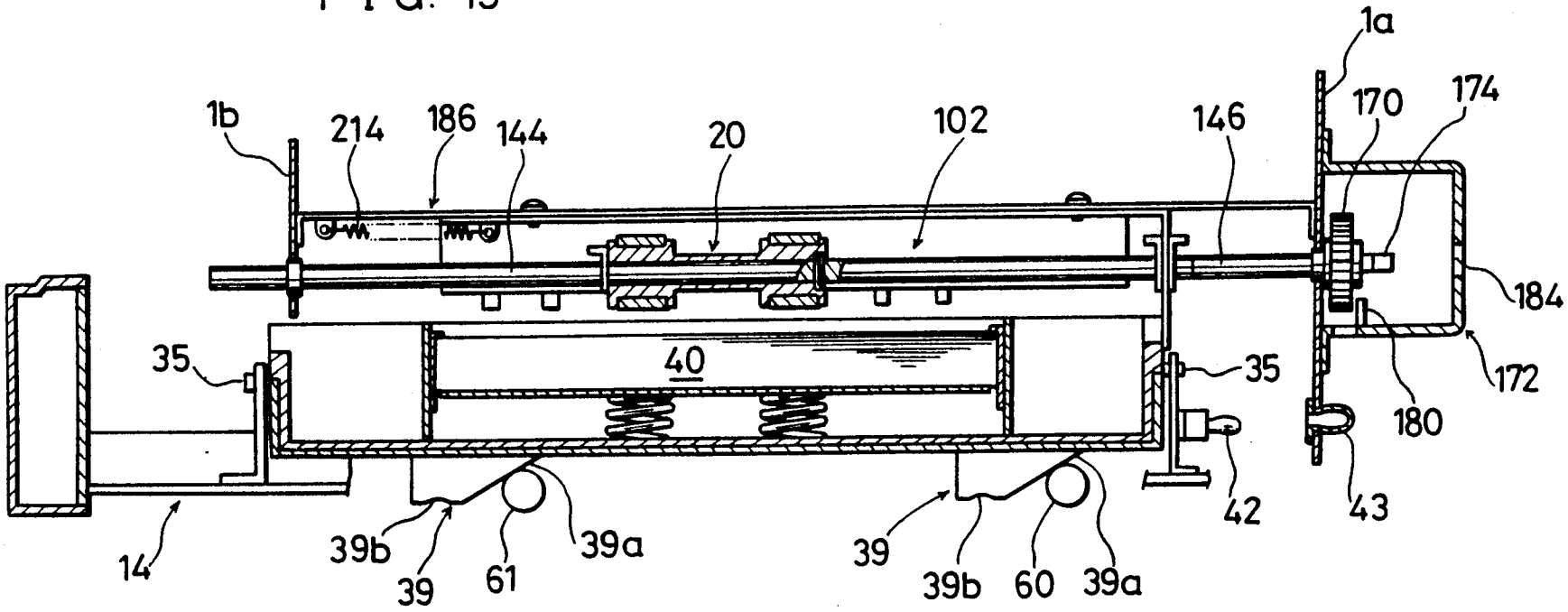
FIG. 13 is a view corresponding to FIG. 6, showing the cassette case in the same operational state as in FIG. 12.

At this point, that is before the rails 39 ride onto either of the rollers 60 and 61, the feed roller 20 is at some distance from the sheet stack 40, as shown in FIGS. 12 and 13. Then, as the cassette case 5 is inserted further into the copying machine body 1 beyond the position shown in FIGS. 12 and 13, the oblique surfaces 39*a* of the rails 39 ride along either of the rollers 60 and 61 until the rail recesses 39*b* catch on the rollers, as shown in FIGS. 4 and 6. Consequently, the cassette case 5 is pivoted about the pins 35, and the opposite end near the feed roller 20 is raised, whereby the uppermost sheet in the cassette case 5 comes into contact with the feed roller 20.

As the support mechanism 14 is inserted into the copying machine body 1, the cassette case 5, acting on the connecting arm 194, slides the linking bracket 190 rearward. Thus, while the cassette case 5 is raised through the action of the rails 39 on the rollers 60 and 61, the feed roller 20 moves rearward in tandem with the rearward movement of the cassette case 5. Thus there is no relative movement in the horizontal direction between the feed cassette 15 within the cassette case 5, and the feed roller 20, preventing lateral displacement of the sheets of stack 40 as they are brought into contact with the feed roller 20.

The moment each of the recesses 39*b* of the rails 39 catch on each of the rollers 60 and 61, the knob 42 fits into the clasper 43, securing the support mechanism within the copying machine body 1. Since the support mechanism 14 does not move vertically, engagement of the knob 42 with the clasper 43 of the catching mechanism is ensured.

In addition, since coil springs 41*c* of elastic force suitable for a given sheet size are provided in each feed cassette 15 to be housed in the cassette case 5, the stack of sheets 40 is brought into appropriate contact with the feed roller 20. Consequently, feeding performance is improved. Moreover, since the cassette case 5 housing the feed cassette 15 is pivotably supported at a position away from the feed roller 20, and the end of the cassette case 5 near the feed roller 20 is raised to bring the sheets of stack 40 into contact with the feed roller 20, contact of the sheets 40 with the feed roller 20 is precise, which further improves the feeding performance.

A typical instance in which the feed roller 20 must be replaced is when the rings 158 of the feed roller 20 have worn away from protracted use. The feed roller 20 is then replaced as follows.

First, the cassette case 5 is drawn out of the copying machine body 1. Next the stop ring 168 is removed from the support shaft 144. Then, the feed roller 20 is moved forward so that the pin 164 may be withdrawn from the support shaft 144, freeing the feed roller 20 so that it is slidable along the axle 142.

Figure 9:
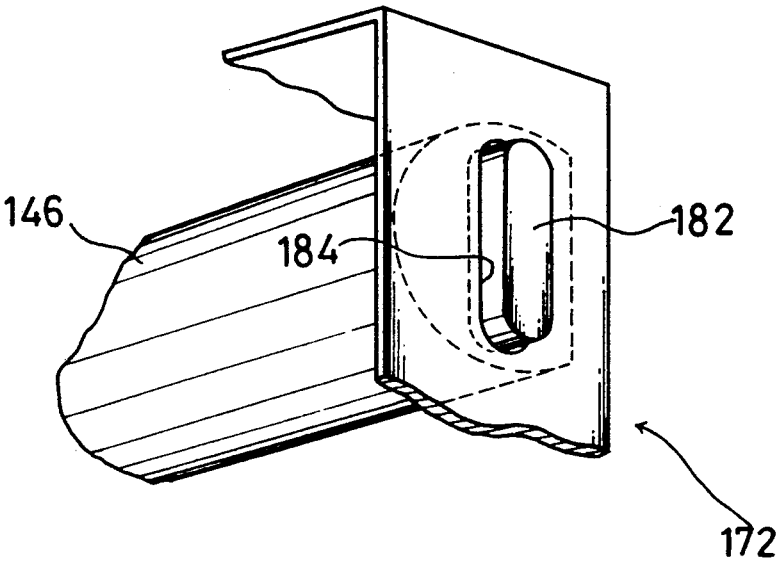
FIG. 9 is an enlarged partial view of a mechanism shown in FIG. 8.

The stop rings 206 are removed from the axle 142, allowing it to slide relative to the linking bracket 190 in the axial direction. The axle 142 is then moved rearward and the projection 182 is fitted into the slot 184, as shown in FIG. 9. The input shaft 146 of the axle 142 is thus prevented from rotating.

In this state, the support shaft 144 is unscrewed in order to separate it from the input shaft 146, to which the gear 170 is coupled. The support shaft 144 can then be drawn out forward without difficulty. The feed roller 20 is thus detached from the support shaft 144.

By performing the reverse of the operations as described above a new feed roller 20 can then be fixed onto the axle 142 such that the condition shown in FIG. 6 is reestablished.

Other Embodiments (a) Additional recess 77 and positioning means 80 may be provided according to the number of different kinds of feed cassettes 15.

Figure 14:
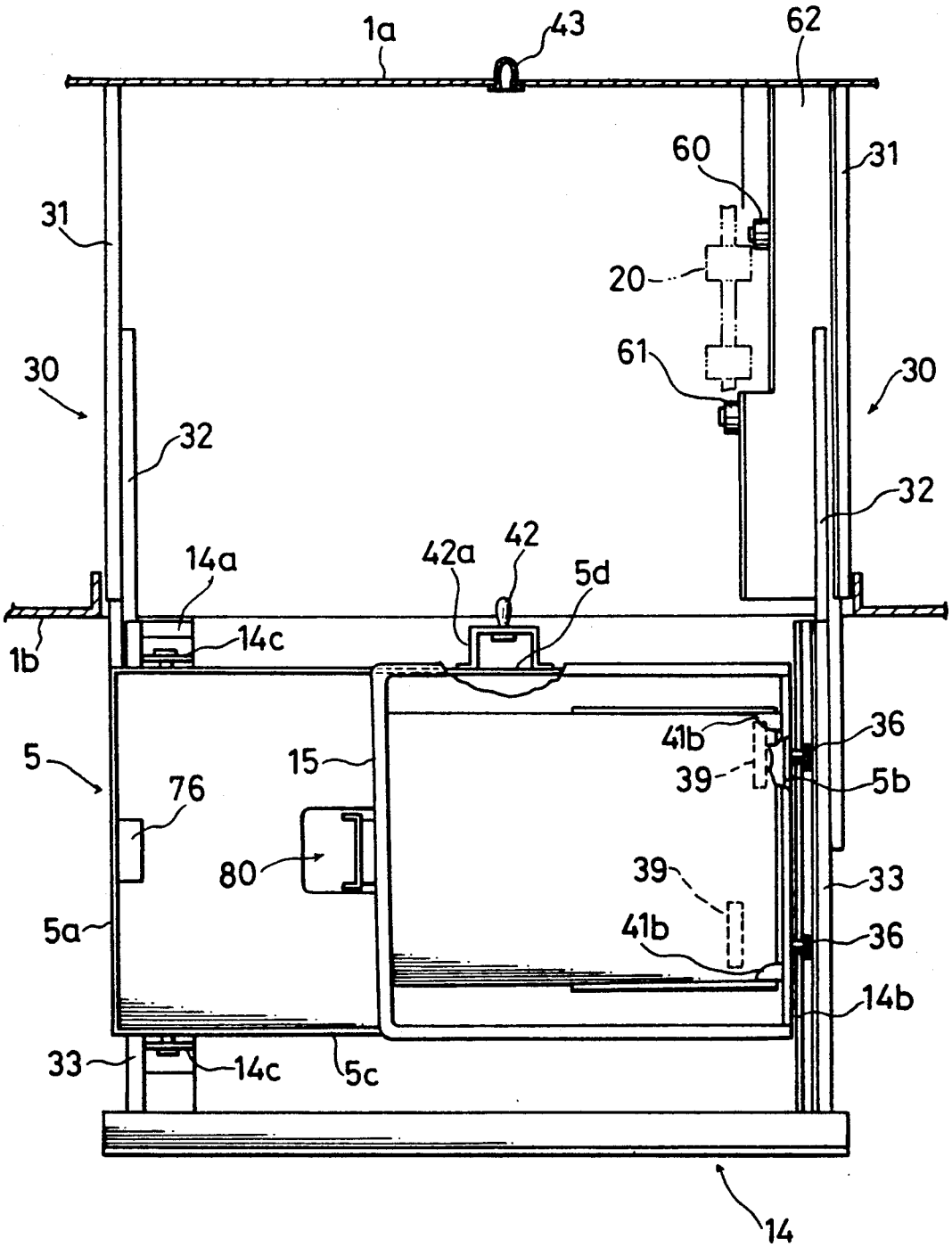
FIG. 14 is a view corresponding to the view of FIG. 3, showing another embodiment.

(b) As shown in FIG. 14, the support plate 42*a* on which the knob 42 is fixed may be mounted directly onto the end wall 5*d* of the cassette case 5, wherein the supporting plate 14*d* is omitted.

Various details of the invention may be changed without departing from its spirit not its scope. Furthermore, the foregoing description of the embodiments according to the present invention is provided for the purpose of illustration only, and not for the purpose of limiting the invention as defined by the appended claims and their equivalents.

What is claimed is:

1. A feed cassette apparatus for retaining a loaded feed cassette in a cassette housing space containing a feed roller, wherein such a feed cassette is loaded and unloaded in the direction parallel to the axis of rotation of said feed roller, said apparatus comprising:

a cassette case movable in a direction parallel to the axis of rotation of said feed roller and capable of housing feed cassettes of different sizes; and a plurality of positioning means for positioning under said feed roller, an end of a stack of sheets stacked in a feed cassette, said plurality of positioning means being disposed at different positions in said cassette case so as to correspond to different sizes of feed cassettes.

2. An apparatus according to claim 1, further including means, movable in the direction parallel to the axis of rotation of said feeder roller, for supporting said cassette case in a vertically movable manner.

3. An apparatus according to claim 1, wherein at least one of said positioning means is disposed below said cassette case body.

4. An apparatus according to claim 3, wherein one of said positioning means has a retentive contact portion, and is able to move between a retracted position, wherein it is positioned below said cassette case, and a set position, wherein said contact portion retentively contacts a loaded feed cassette.

5. An apparatus according to claim 4, wherein said cassette case includes a recess the bottom of which has a receive portion; and said positioning means includes a pressing means having an engage portion, whereby said positioning means is put into said set position by the engagement of said engage portion with said receive portion.

6. An apparatus according to claim 5, further including connecting means including a pin and slot provided between said cassette case and said pressing member, wherein said pin travels along said slot when the position of said pressing means is changed.

7. An apparatus according to claim 6, wherein said pressing means is retained in said set position by said pin and slot, in addition to said engagement of said engage portion and receive portion.

8. An apparatus according to claim 5, wherein said pressing means includes an urging means for retentively urging a feed cassette.

9. An apparatus according to claim 4, wherein one of said positioning means is a pressing means which serves as a side wall of said cassette case.

10. An apparatus according to claim 9, wherein said pressing means includes an urging member of which force retains a feed cassette.

11. A feed cassette apparatus for retaining a loaded feed cassette in a cassette housing space containing a feed roller, wherein said feed cassette is loaded and unloaded in the direction parallel to the axis of rotation of said feed roller, comprising:

a cassette case for removably housing said feed cassette; and a support means for supporting said cassette case in a vertically movable manner, said support means being movable in the direction parallel to the axis of rotation of said feed roller.

12. An apparatus according to claim 11, wherein said feed cassette includes means for providing feeding pressure to suit a given size of sheet.

13. An apparatus according to claim 12 further including means for raising an end of said feed cassette adjacent said feed roller, whereby a sheet in said feed cassette is brought into contact with said feed roller; wherein said supporting means pivotably supports the side of said cassette case away from said feed roller.

14. An apparatus according to claim 13, wherein said raising means includes a rail member having an oblique surface, and a roller on which said rail member rides, wherein said rail member and roller are provided between said cassette case and cassette housing space.

15. An apparatus according to claim 13, further including a pair of clasping elements for detachably fixing said cassette case into said housing space, provided at locations in said cassette case and said housing space, respectively.

16. An apparatus according to claim 12, further including means for disengageably fastening said support means into said cassette housing space.

17. An apparatus according to claim 16, wherein said fastening means includes a pair of clasping elements provided on said support means and said cassette housing space.

18. An apparatus according to claim 17, wherein said clasping elements are made of resin.

19. An apparatus according to claim 11 further including means for detachably fastening said support means within said cassette housing space.

20. An apparatus according to claim 19, wherein said fastening means includes a pair of clasping elements provided on said support means and said cassette housing space.

21. An apparatus according to claim 20, wherein said clasping elements are made of resin.

22. An apparatus according to claim 11, wherein said cassette case is capable of housing feed cassettes of different sizes; further including a plurality of positioning means for positioning under said feed roller, the end of a stack of sheets stacked in said feed cassette, said plurality of positioning means being disposed at different positions in said cassette case to correspond to the different sizes of said feed cassettes.

* * * * *

UNITED STATES PATENT AND TRADEMARK OFFICE

CERTIFICATE OF CORRECTION

PATENT NO. : 5,236,187

DATED : August 17, 1993

INVENTOR(S) : Naoki Mizutani

It is certified that error appears in the above-identified patent and that said Letters Patent is hereby corrected as shown below:

On title page, item [30] Foreign Application Priority Data

4th line, change "Nov. 20, 1991 [JP] Japan..... 3-29611" to --Nov. 20, 1991 [JP] Japan..... 3-329611--.

Signed and Sealed this

Twelfth Day of April, 1994

*Attest:*

*Attesting Officer*

BRUCE LEHMAN

*Commissioner of Patents and Trademarks*